United States Patent [19]

Ssinegurski

[11] 4,244,327

[45] Jan. 13, 1981

[54] STEAM GENERATOR ARRANGEMENT

[75] Inventor: Eugen Ssinegurski, Simsbury, Conn.

[73] Assignee: Combustion Engineering, Inc., Windsor, Conn.

[21] Appl. No.: 47,419

[22] Filed: Jun. 11, 1979

[51] Int. Cl.[3] ..... F22B 37/10

[52] U.S. Cl. ..... 122/235 A; 122/6 A; 122/468; 122/235 D

[58] Field of Search ..... 122/468, 469, 460, 461, 122/235 R, 235 A, 235 D, 6 A

[56] References Cited

U.S. PATENT DOCUMENTS

| | | | |
|---|---|---|---|
| 3,159,146 | 12/1964 | Rudolph | 122/235 A |
| 3,178,881 | 12/1979 | Pratt et al. | 122/235 A |
| 3,196,842 | 7/1965 | Huge et al. | 122/235 A |
| 3,263,423 | 8/1966 | Gorezegno et al. | 122/468 |
| 4,145,996 | 3/1979 | Brandes et al. | 122/6 A |
| 4,191,133 | 3/1980 | Stevens | 122/235 R |

*Primary Examiner*—Henry C. Yuen

*Attorney, Agent, or Firm*—Edward L. Kochey, Jr.

[57] ABSTRACT

A steam flow path arrangement for covering the walls of the rear gas pass of a steam generator. The entire flow passes down the sidewalls with a minor portion then passing up through the rear wall to a superheater inlet header at an intermediate elevation. The major portion of the flow passes up the front wall and through hanger tubes to a roof header. From there the major portion passes across the roof and down the rear wall to the superheater inlet header at the intermediate elevation.

7 Claims, 2 Drawing Figures

STEAM GENERATOR ARRANGEMENT

BACKGROUND OF THE INVENTION

This invention relates to fossil fuel-fired steam generators and in particular to a steam flow path arrangement for covering the walls of the rear gas pass.

In a large fossil fuel-fired steam generator fuel is fired into a vertically extending furnace and steam is generated in the tubes lining the walls of the furnace. Gas leaving the top of the furnace passes horizontally to a rear gas pass and then passes downwardly through the gas pass as it travels toward the stack. Within the horizontally flowing portion and in the downwardly flowing rear pass, tubular heat exchange surface is supported. This heating surface is used to superheat the steam and to reheat the steam after an initial traverse through the portion of the turbine. Economizer heating surface is also normally suspended at the bottom of the vertical gas pass.

The gas flowing through this gas pass tends to be at a temperature level higher than that of the saturated steam, and it is conventional to cool the walls by lining them with tubes carrying saturated steam between the drum and the superheater surface. These tubes not only line the wall for cooling purposes but also act as support members for the walls themselves and other pressure and nonpressure parts.

Heat transfer to the walls is normally relatively low since there is little radiation at the low gas temperature levels and the tube-covered wall does not have high convection heat transfer characteristics. The tubes lining the front wall of the rear gas pass, however, pass upwardly through the gas inlet to a support elevation above the roof, and thereby are exposed to convection heat transfer where the gases flow across the tubes. It is important that these tubes be at relatively uniform temperatures since any particular hanger tube becoming hot will expand and tend to release the load carried by the particular tube so that other tubes are subject to increased loading. Furthermore, a hot tube which releases its load is subject to less tension and is more likely to vibrate because of the flue gases passing thereover. It is, accordingly, important that these tubes operate at the same temperature as one another.

Downflow through these tubes produces a tendency toward unstable flow since a tube which starts to become hotter has less dense steam therein. This results in increasingly less flow in the particular tube; and as a result, the steam and the tube become even hotter, with the flow tending to decrease even further. With an upflow situation any overheating of the tube has a tendency to increase the flow and is, therefore, self-stabilizing.

Inlet headers for superheaters or reheaters must be supported within the gas pass; and where the superheater inlet header cannot be supported in the steam-cooled wall itself, complex support arrangements are required.

Various tubing arrangements are also subject to erosion because of the fly ash contained within the gases. This is particularly difficult immediately adjacent the walls where gas at high velocity tends to bypass the heating surface. Where a header located in the wall is required to receive tubes from above and to also supply tubes from above, the large number of openings in the header requires that some of these tubes be bent into the gas pass, thereby aggravating the erosion problem.

Futhermore where tubes must pass down the wall for cooling the walls and then must flow from a lower header to superheater surface, double wall tubing is required which increases the cost of tubing and also requires additional support arrangements to hold the tubing back to the wall.

SUMMARY OF THE INVENTION

A steam flow path arrangement carries saturated steam after it leaves the steam drum and prior to entry of a low temperature superheater. The conventional rear gas pass has an opening in the upper portion of the front wall where the flue gas passes in and then passes downwardly through the rear path. Cooling of the walls terminates at a lower elevation and the gas passes downwardly through this point, thereafter entering through the rear wall below the location at which the walls must be cooled.

The roof, the two sidewalls, the rear wall and the front wall of the gas pass are all lined by parallel tubes. A superheater inlet header is located in the plane of the rear wall at an intermediate elevation receiving the tubes above and below that elevation. An inlet header is located above the sidewall tubes and an outlet header below the sidewall tubes. The front wall has tubes extending upwardly through the gas opening, and this wall has an outlet header located at the top and an inlet header located at the bottom.

Flow of saturated steam passes downwardly through the sidewalls to the lower header with a minor portion of the flow passing from this header to a lower header in a rear wall then upwardly through tubes lining that wall to the superheater inlet header.

A major portion of the flow passes to the inlet header of the front wall and upwardly along the front wall, across the roof tubes and down the rear wall to the inlet header.

The hanger tubes of the front wall are carrying a majority of the steam flow and are, furthermore, carrying this steam in an upward direction through the hanger tubes where the steam is subjected to convection heat transfer. This tends to stabilize the temperature in these tubes and maintain equal loading in all tubes.

The superheater inlet header is located within the rear wall thereby simplifying support problems and minimizing erosion problems.

No double tubing is required in the arrangement thereby minimizing the cost and also further decreasing erosion problems.

DETAILED DESCRIPTION OF THE PREFERRED EMBODIMENT

Figure 1:
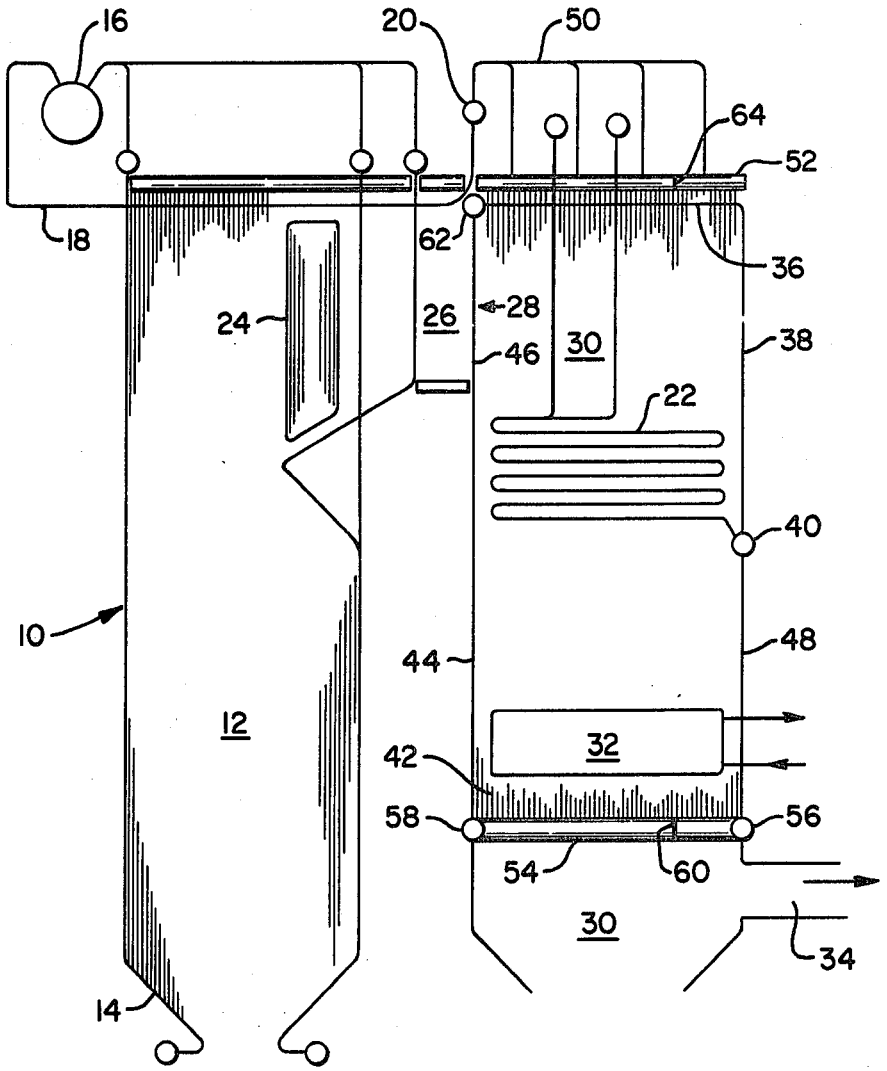
FIG. 1 is a schematic side elevation of a steam generator indicating the general location of the rear gas pass.
Figure 2:
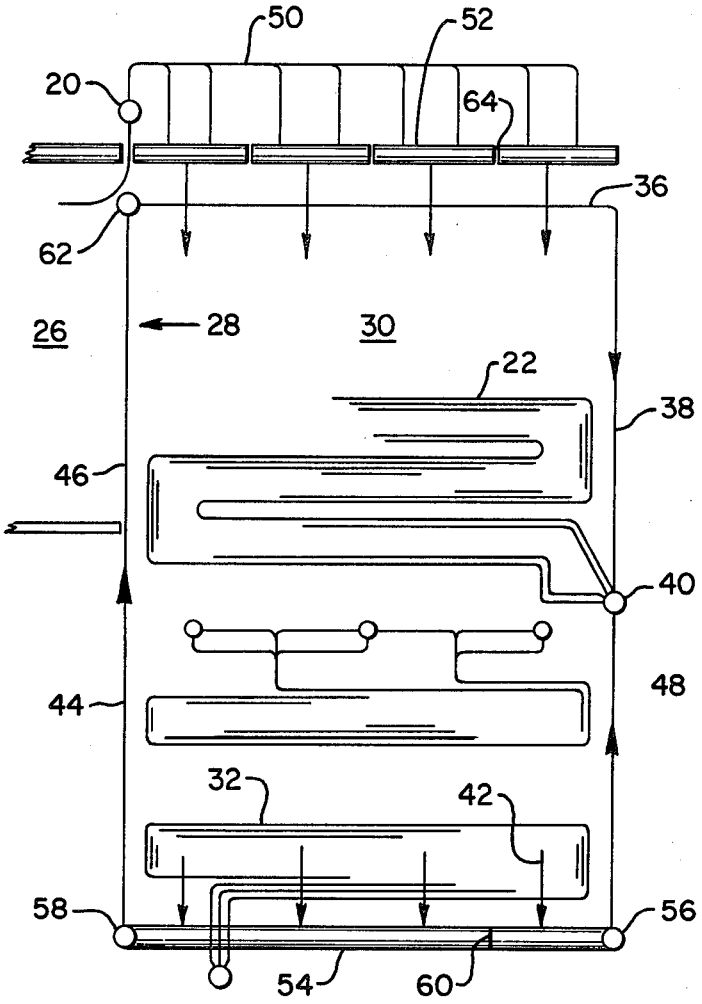
FIG. 2 is an illustration of the steam flow path arrangement covering the walls of the rear gas pass.

Fuel is fired through fuel and air nozzles 10 into furnace 12 which is lined by steam generating tubes 14. Steam generated from the boiler water is released in steam drum 16 and passes through saturated steam tubes 18 across the roof of the furnace to the furnace roof outlet header 20. The steam is passed through low temperature superheater 22 which is formed of tubular heat exchange surface and then through finishing superheater 24 before passage to a turbine. Additional steam heating surface for reheating the steam may be supplied if desired.

Flue gas formed by the combustion of the fuel passes upwardly out of the furnace through horizontal gas pass 26 through an opening 28 into rear gas pass 30. The gas passes downwardly through the rear gas pass and is cooled in this passage by superheater 22 and economizer 32. As it leaves the rear gas pass through duct 34, it is at a sufficiently low temperature that uncooled steel plates may be used to form the duct.

A first plurality of parallel tubes 36 line the roof of the gas pass. These tubes are preferably welded together by means of fins welded to the adjacent tubes to form a gas-tight wall. These are directly connected to a second plurality of parallel tubes 38 which line the rear wall of the gas pass down to an intermediate elevation at which point the superheater inlet header 40 is located. This single location of the superheater inlet header decreases cost compared to headers located near both the front and rear walls. A third plurality of parallel tubes 42 line the two sidewalls of the rear gas pass, and a fourth plurality of parallel tubes 44 line the front wall of the rear gas pass. The tubes of the front wall are welded together up to gas opening 28, and from this elevation to the roof elevation independent hanger tubes 46 pass through the gas pass. This permits the gas to pass through the area, and the tubes operate to support the rear wall.

A fifth plurality of parallel tubes 48 complete the coverage of the rear gas pass by covering the rear wall from a lower elevation to the superheater inlet header 40.

Generally, saturated steam from the furnace roof outlet header 20 is carried by jumper tubes 50 to a first header 52 which is an inlet header for the sidewall tubes. Substantially the entire steam flow from the steam generator passes down these sidewalls to a second header 54 located on each sidewall and which serves as an outlet header for the sidewalls.

The lower header 54 is connected to a third header 56 by 90° elbows. The header 54 is also connected to a fourth header 58 by 90° elbows. The combination of the two headers 54 on each of the sidewalls together with the front wall header 58 forms a U header, and a ring header is formed when 90° elbows are used to join header 56 with the two sidewall headers 54. A partition plate 60 is located in each header 54 at a location to provide a minor portion of the steam flow passing to header 56 with a major portion of the steam flow passing to header 58.

The minor portion of the steam flow passes upwardly through the plurality of parallel tubes 48 to a fifth header 40 which is the horizontal superheater inlet header.

The major portion of the steam flow passes from header 58 upwardly through the plurality of parallel tubes 44 and hanger tubes 46 to a sixth header 62 located at or above the roof elevation. This major portion of the steam flow passes from header 62 serially through the plurality of tubes 36 and 38 to the fifth header 40 at which location it joins the minor portion of steam flow for passage through superheater 22.

It can be seen that two parallel flow paths exist at least from header 52 through the walls of the rear gas pass to the superheater inlet header 40. A minor portion of the flow passes through the rearmost sidewall tubes through header 56 and up through the lower portion of the rear wall to the superheater inlet header 40. This minor portion of flow can adequately cool the lower wall through tubes 48 even though the minor portion of steam flow must cover the entire rear wall of the furnace. Relatively little cooling is required since the gas temperature at this location tends to be low and upflow through these tubes eliminates any flow stability problem due to overheating.

The major portion of steam flow passes through the entire front wall 44 which is essentially of the same width as the rear wall. This additional steam flow is beneficial here, however, since the steam must pass through the hanger tubes 46 and the high flow through these sections tends to equalize the temperatures. This high flow also is passed thereafter through the downflow plurality of tubes 38, and the relatively high flow increases the stability in these tubes. It is also noted that the hanger tubes 46 receive upwardly flowing steam thereby also eliminating stability problems in these critical hanger tubes.

Sidewall inlet header 52 may be an open header and, in this case, may receive steam flow from header 22 by 90° connections between the header 20 and the header 52. It may alternately be comprised of a plurality of stub headers which will facilitate erection. As illustrated partition plate 64 may be located in the header at a location similar to partition plate 60. This permits the use of the downflow sidewall tubes as well as the jumper tubes 50 to stabilize the relative flow through the tube parallel circuits.

Since superheater inlet header 40 has no requirements for cross flow, this may also be formed of a plurality of stub headers to simplify erection.

Each of the headers forming a portion of the rear pass walls receives tubes from only one direction; and, therefore, a double layer of tubes is not required at any location. This avoids the expense of supplying and supporting those tubes and further avoids some erosion problems since the tubes need not be offset into the furnace simply to gain access to the headers. The superheater inlet header 40 is supported in the rear wall; and, accordingly, no complex support arrangement is required for this header.

What is claimed is:

1. A steam flow path arrangement for a vertical gas flow pass of a steam generator; said vertical gas flow pass having a rectangular cross section and an opening in a front wall at an upper elevation for the ingress of flue gas, an opening at the bottom for egress of flue gas, and a tubular superheater located within said gas pass, comprising: a first plurality of parallel tubes lining the roof of said gas pass; a second plurality of parallel tubes lining the rear wall of said gas pass from the roof elevation to an intermediate elevation; a third plurality of parallel tubes lining the side walls of said gas pass from the roof elevation to a lower elevation; a fourth plurality of parallel tubes lining the front wall of said gas pass from the top of said front wall to said lower elevation, said tubes also passing through the front wall opening; a fifth plurality of parallel tubes lining the rear wall of said gas pass from said intermediate elevation to said lower elevation; first header means attached to the upper end of said third plurality of tubes for conveying substantially all of the steam flow therethrough; a second header means connected to the bottom end of said third plurality of parallel tubes for receiving substantially all the steam flow; a third header means connected to the bottom of said fifth plurality of tubes; a first conveying means for conveying a minor portion of the steam flow from said second header means to said third header means; fourth header means connected to the bottom of said fourth plurality of parallel tubes; a second conveying means for conveying a major portion of the steam flow from said second header means to said fourth header means; a fifth header means connected to the bottom of said second plurality of parallel tubes and to the top of said fifth plurality of parallel tubes; said fourth, first, and second plurality of parallel tubes connected for serial flow therethrough; and supply tubes connecting said fifth header to said tubular superheater.

2. A steam flow path arrangement as in claim 1 wherein said second headers of each sidewall and said fourth header of the front wall are joined by 90° elbows to form a U-shaped header.

3. The steam flow path arrangement as in claim 2 wherein said third header of the rear wall is joined by 90° elbows to said second headers of the sidewall, thereby forming a ring header of said second, third, and fourth headers.

4. A steam flow path arrangement as in claim 3 including also partition plates and each of said second headers for dividing the steam flow through said third plurality of parallel tubes into a minor portion for transmittal to said third header and a major portion for transmittal to said fourth header.

5. An apparatus as in any one of claims 1 through 4 having also a sixth header connected to the top of said fourth plurality of parallel tubes and to the inlet end of said first plurality of parallel tubes.

6. An apparatus as in claim 1 or 4 wherein said fifth header is comprised of a plurality of stub headers.

7. An apparatus as in claim 1 or 4 wherein said first header is comprised of a plurality of stub headers.

* * * * *